US006673298B2

(12) United States Patent
Krueger

(10) Patent No.: US 6,673,298 B2
(45) Date of Patent: Jan. 6, 2004

(54) TAMPER INDICATING CLOSURE WITH FOLDABLE TAB

(75) Inventor: David F. Krueger, Lancaster, PA (US)

(73) Assignee: Kerr Group, Inc., Lancaster, PA (US)

( * ) Notice: Subject to any disclaimer, the term of this patent is extended or adjusted under 35 U.S.C. 154(b) by 0 days.

(21) Appl. No.: 10/041,398

(22) Filed: Jan. 8, 2002

(65) Prior Publication Data

US 2002/0079618 A1 Jun. 27, 2002

Related U.S. Application Data

(62) Division of application No. 09/131,371, filed on Aug. 7, 1998, now Pat. No. 6,371,317.

(51) Int. Cl.[7] ..... B65D 41/32
(52) U.S. Cl. ..... 264/295; 215/252
(58) Field of Search ..... 215/252, 253, 215/258, 317; 264/295

(56) References Cited

U.S. PATENT DOCUMENTS

| | | | |
|---|---|---|---|
| 2,032,521 | A | 3/1936 | Barton |
| 2,148,468 | A | 2/1939 | Hothersall |
| 2,205,685 | A | 6/1940 | Conner |
| 3,902,630 | A | 9/1975 | Knize |
| 4,458,821 | A | 7/1984 | Ostrowsky |
| 4,470,513 | A | 9/1984 | Ostrowsky |
| 4,478,343 | A | 10/1984 | Ostrowsky |
| 4,506,795 | A | 3/1985 | Herr |
| 4,511,054 | A | 4/1985 | Shank |
| 4,546,892 | A | 10/1985 | Couput |
| 4,550,844 | A | 11/1985 | Lininger |
| 4,572,388 | A | 2/1986 | Luker et al. |
| 4,576,299 | A | 3/1986 | Lecinski, Jr. |
| 4,595,110 | A | 6/1986 | Herr |
| 4,595,547 | A | 6/1986 | Herr |
| 4,598,833 | A | 7/1986 | Herr |
| 4,643,321 | A | 2/1987 | Gach |
| 4,653,657 | A | 3/1987 | Papavasilopoulos |
| 4,657,153 | A | 4/1987 | Hayes |
| 4,732,289 | A | 3/1988 | Granat et al. |
| 4,789,076 | A | 12/1988 | Jewitt et al. |
| 4,796,770 | A | 1/1989 | Begley |
| 4,801,030 | A | 1/1989 | Barriac |
| 4,801,031 | A | 1/1989 | Barriac |
| RE32,879 | E | 2/1989 | Wright et al. |
| 4,807,771 | A | 2/1989 | Roy et al. |
| 4,813,561 | A | 3/1989 | Ochs |
| 4,848,614 | A | 7/1989 | Csaszar |
| 4,863,030 | A | 9/1989 | Bayer et al. |
| 4,875,594 | A | 10/1989 | Ochs |
| 4,938,370 | A | 7/1990 | McBride |
| 4,978,016 | A | 12/1990 | Hayes |
| 4,978,017 | A | 12/1990 | McBride |
| 4,981,230 | A | 1/1991 | Marshall et al. |
| 4,997,097 | A | 3/1991 | Krautkrämer |
| 5,007,545 | A | 4/1991 | Imbery, Jr. |
| 5,050,753 | A | 9/1991 | Trump et al. |

(List continued on next page.)

FOREIGN PATENT DOCUMENTS

| | | |
|---|---|---|
| AU | 647048 | 3/1991 |
| AU | 648537 | 10/1991 |
| AU | 650056 | 3/1992 |
| DE | 41 08 453 | 10/1991 |
| EP | 0 390 412 | 10/1990 |
| WO | 91/03405 | 3/1991 |

*Primary Examiner*—Lee Young
*Assistant Examiner*—Joseph C. Merek
(74) *Attorney, Agent, or Firm*—Kenyon & Kenyon

(57) ABSTRACT

A tamper indicating closure according to the present invention includes a top wall and a skirt depending from the top wall. A tamper indicating band is connected to the skirt along a frangible line. The tamper indicating band includes a ring and at least one tab, the at least one tab having a bi-stable geometric shape. In particular, the tab includes a pair of extending members angled toward one another and connected by a transverse member. The shape of the tab allows it to be molded in a downward orientation and later folded to a stable, upward orientation without reheating or otherwise resetting the tab.

3 Claims, 6 Drawing Sheets

U.S. PATENT DOCUMENTS 5,054,268 A 10/1991 Hayes et al.
5,058,755 A 10/1991 Hayes
5,080,246 A 1/1992 Hayes
5,090,788 A 2/1992 Ingram et al.
5,129,530 A 7/1992 Fuchs
5,167,335 A 12/1992 McBride et al.
5,197,620 A 3/1993 Gregory
5,205,426 A 4/1993 McBride et al.
5,219,507 A 6/1993 Ingram et al.
5,282,540 A 2/1994 Beck
5,295,600 A 3/1994 Kowal
5,310,069 A 5/1994 Ingram et al.
5,370,520 A 12/1994 Ingram et al.
5,397,009 A 3/1995 Salmon et al.
5,443,171 A 8/1995 Sprowl
5,450,973 A 9/1995 Ellis et al.
5,462,184 A 10/1995 Ingram et al.
5,488,888 A 2/1996 Kowal
5,582,308 A 12/1996 Kishi et al.
5,611,446 A 3/1997 Ingram et al.
5,657,889 A 8/1997 Guglielmini
5,667,087 A 9/1997 Delatour et al.
5,676,269 A 10/1997 Blake et al.
5,678,714 A 10/1997 Guglielmini
5,685,443 A 11/1997 Taber et al.
5,690,882 A 11/1997 Sprowl
5,755,347 A 5/1998 Ingram-

TAMPER INDICATING CLOSURE WITH FOLDABLE TAB

CROSS-REFERENCE TO RELATED APPLICATION

This application is a divisional of U.S. Ser. No. 09/131,371 now U.S. Pat. No. 6,371,317, filed on Aug. 7, 1998.

FIELD OF THE INVENTION

The present invention relates to container closures, and in particular to closures including tamper indication such as a tamper indicating band.

BACKGROUND INFORMATION

Tamper indicating closures for bottles and other containers are designed to indicate to the consumer when the container has been opened or otherwise tampered with. Known tamper indicating closures typically include a flat, circular closure top and an annular skirt depending downwardly from the outer rim of the closure top. The inner surface of the skirt portion includes threads which interact with a threaded portion of the container neck to retain the closure on the container.

Tamper indicating closures also typically include a tamper indicating band connected to the bottom of the skirt along a frangible line or joint. The tamper indicating band is generally an annular member which may have a plurality of inwardly and upwardly extending tabs that are retained beneath an annular shoulder on the neck of the container. When the closure is removed from the container for the first time, the tabs contact the shoulder and cause the tamper indication band to separate from the skirt along the frangible line.

With many known tamper indicating closures, the closure top, skirt, and tamper indicating band are formed integrally. However, due to the complexity and shape of the tamper indication closure, the tabs must often be formed facing downwardly, and later folded upwards. In some cases, this method of manufacturing may require reheating of the closure to set the tabs in an upward and inward position, adding to manufacturing time and costs.

In an effort to avoid this problem, some closures are formed with foldable arrangements. Known foldable arrangements, however, are often formed as unitary, foldable bands spanning the circumference of the closure, rather than individual tabs (see, for example, U.S. Pat. No. 4,546,892 to Couput). These foldable bands, and similar arrangements in which the foldable bands are broken up into large segments, can be difficult to fold. To the extent folding is achieved, the folding process can bend and deform the relatively large bands and segments, decreasing the structural integrity and hence the reliability of the tamper indicating mechanism. Other foldable closures group a plurality of tabs with bridging elements (see, for example, U.S. Pat. No. 4,981,230 to Marshall et al.). These groups may suffer the same drawbacks as the foldable bands described above. Alternatively, the groups may require relatively weak bridges which can rupture, again decreasing the structural integrity and reliability of the mechanism.

SUMMARY OF THE INVENTION

The present invention provides a tamper indicating closure, which includes a top wall, a skirt depending from the top wall, and a tamper indicating band. The tamper indicating band is connected to the skirt along a frangible line. The tamper indicating band includes a ring and a plurality of tabs having a bi-stable geometric shape. Each tab includes a pair of extending members angled toward one another and connected by a transverse member, forming a generally trapezoidal shape. The shape of the tab allows it to be molded in a downward orientation and later folded to a stable, upward orientation, without requiring reheating or other remolding of the closure or tab.

DETAILED DESCRIPTION OF THE PREFERRED EMBODIMENTS

Figure 1:
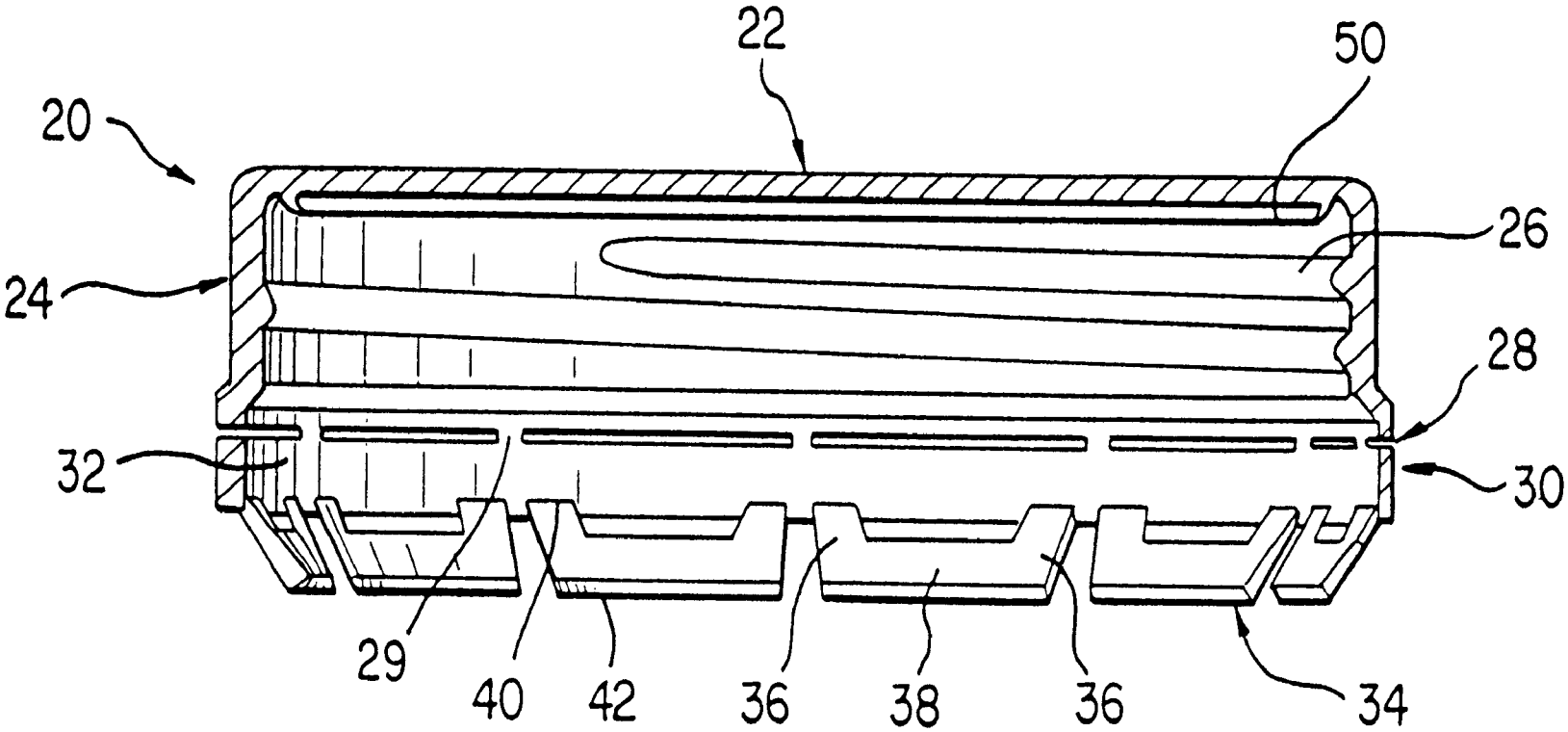
FIG. 1 is a side cross-sectional view of an exemplary closure according to the present invention having tabs in a downward orientation.
Figure 7:
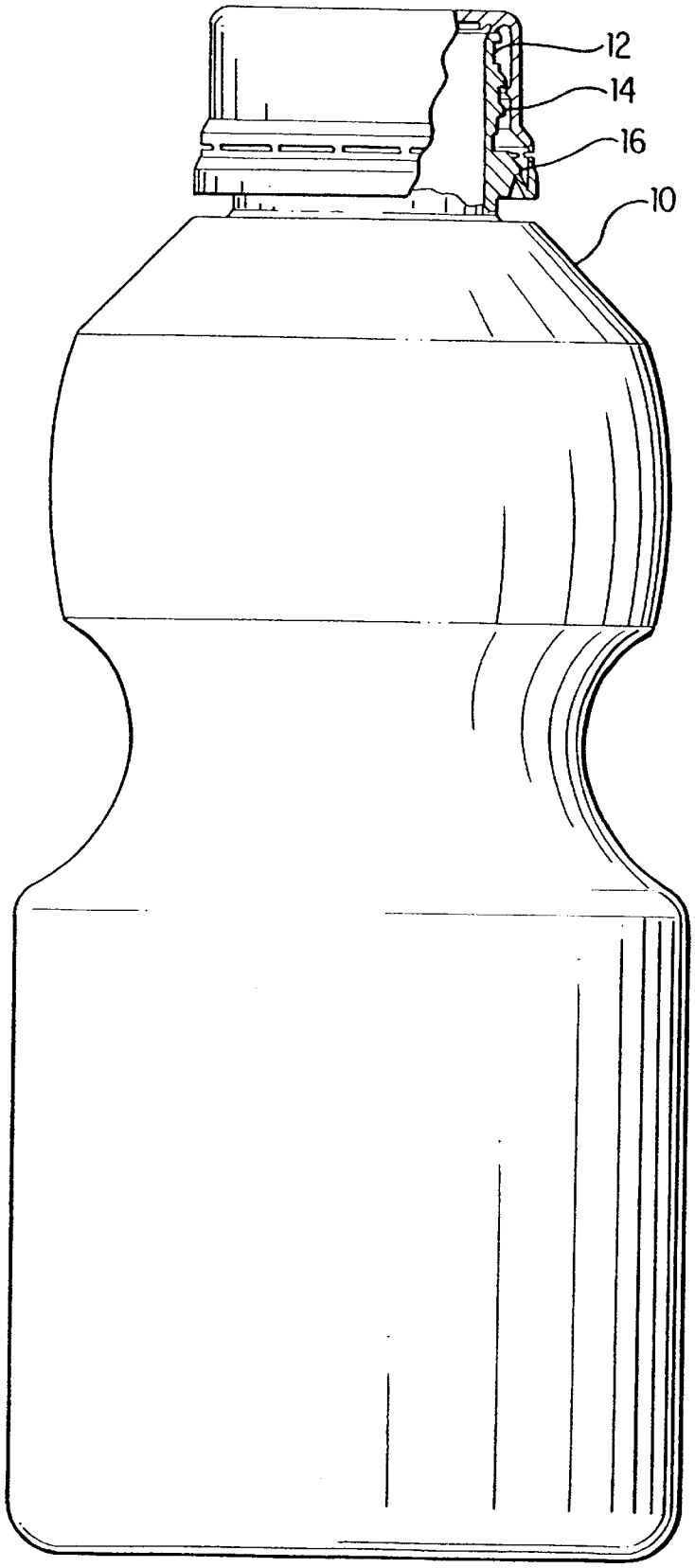
FIG. 7 is a side view of an exemplary container according to the present invention.

FIG. 1 illustrates a closure 20 according to the present invention, which includes a plurality of tabs 34 whose geometric shape allows each tab 34 to be folded upward to a stable position without requiring reheating, remolding or otherwise resetting the tab 34. In general, closure 20 includes a top wall 22, a skirt 24, and a tamper indicating band 30. Top wall 22 is preferably circular in shape, although any suitable shape may be used. Closure 20 also includes a skirt 24, for example an annular skirt 24, depending from the top wall 22. In the illustrated embodiment, skirt 24 depends from the outer edge of top wall 22, but top wall 22 may extend beyond skirt 24 if desired. Skirt 22 includes, for example, at least one internal thread 26 that cooperates with an external thread 14 on container 10 (shown in FIG. 7) to retain closure 20 on container 10. While the illustrated embodiment includes internal and external threads 26 and 14, any suitable retention formation, such as locking lugs, may be provided. The terms "internal thread" and "external thread" should be read to include these alternative formations.

Tamper indicating band 30 is connected to skirt 24 along a frangible line 28. Preferably tamper indicating band 30 is connected to skirt 24 at the bottom of skirt 24, as illustrated in FIG. 1. Frangible line 28 may include any type of frangible formation, for example a score line along the entire circumference or a series of score lines each encompassing a segment of the circumference. In the illustrated embodiment, frangible line 28 includes a plurality of bridges 29. Bridges 29 may be formed during the original molding of closure 20, but preferably frangible line 28 is molded as a solid line. The areas between bridges 29 are then created by scoring, as described, for example, in U.S. Pat. No. 4,595,547, whose disclosure is incorporated herein by reference.

Tamper indicating band 30 includes ring 32, which is preferably annular in shape. Tamper indicating band 30 also includes at least one tab 34, preferably a plurality of tabs 34 arranged circumferentially around ring 32. Preferably tabs 34 are spaced slightly apart, as illustrated in FIG. 1. Each tab 34 generally includes a pair of extending members 36 connected by a transverse member 38, with the extending members 36 of each tab 34 being angled inwardly toward each other. Extending members 36 each are connected to ring 32 at a base 40 of extending member.

Figure 6:
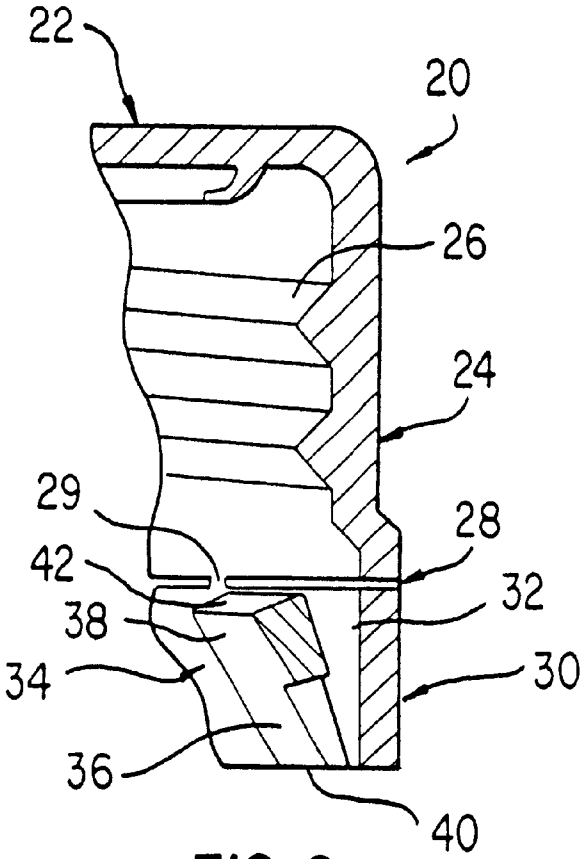
FIG. 6 is another cross-sectional view of the closure of FIG. 5, with the tab in the upward orientation.
Figure 5:
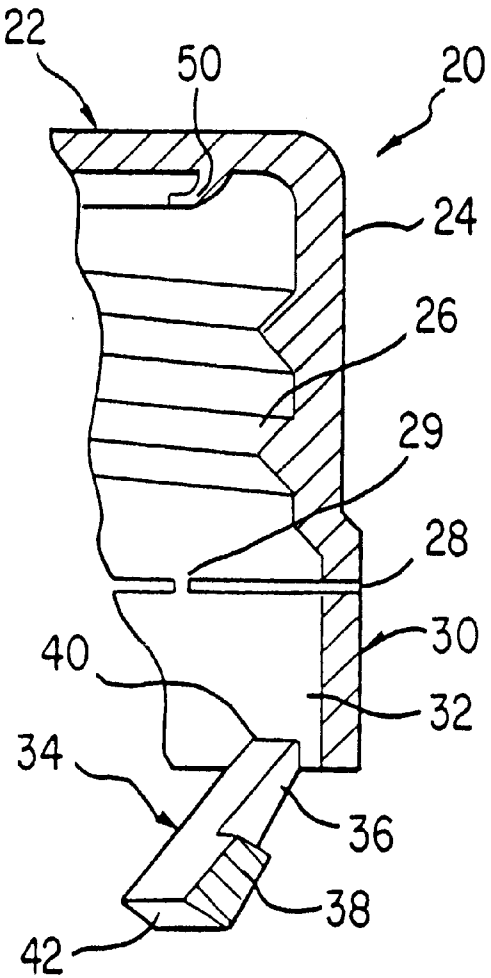
FIG. 5 is a cross-sectional view of an exemplary closure and tab according to the present invention.

Each tab 34 is a generally trapezoidal member having a generally trapezoidal hole therethrough. Preferably the trapezoidal hole is located at the base of tab 34, rather than, for example, in the center of tab 34. The resulting structure comprises the two extending members 36 and transverse member 38. In a preferred embodiment, each tab 34 is relatively thin at its base 40 and gradually thickens moving toward tip 42, as illustrated in FIGS. 5 and 6.

Figure 2:
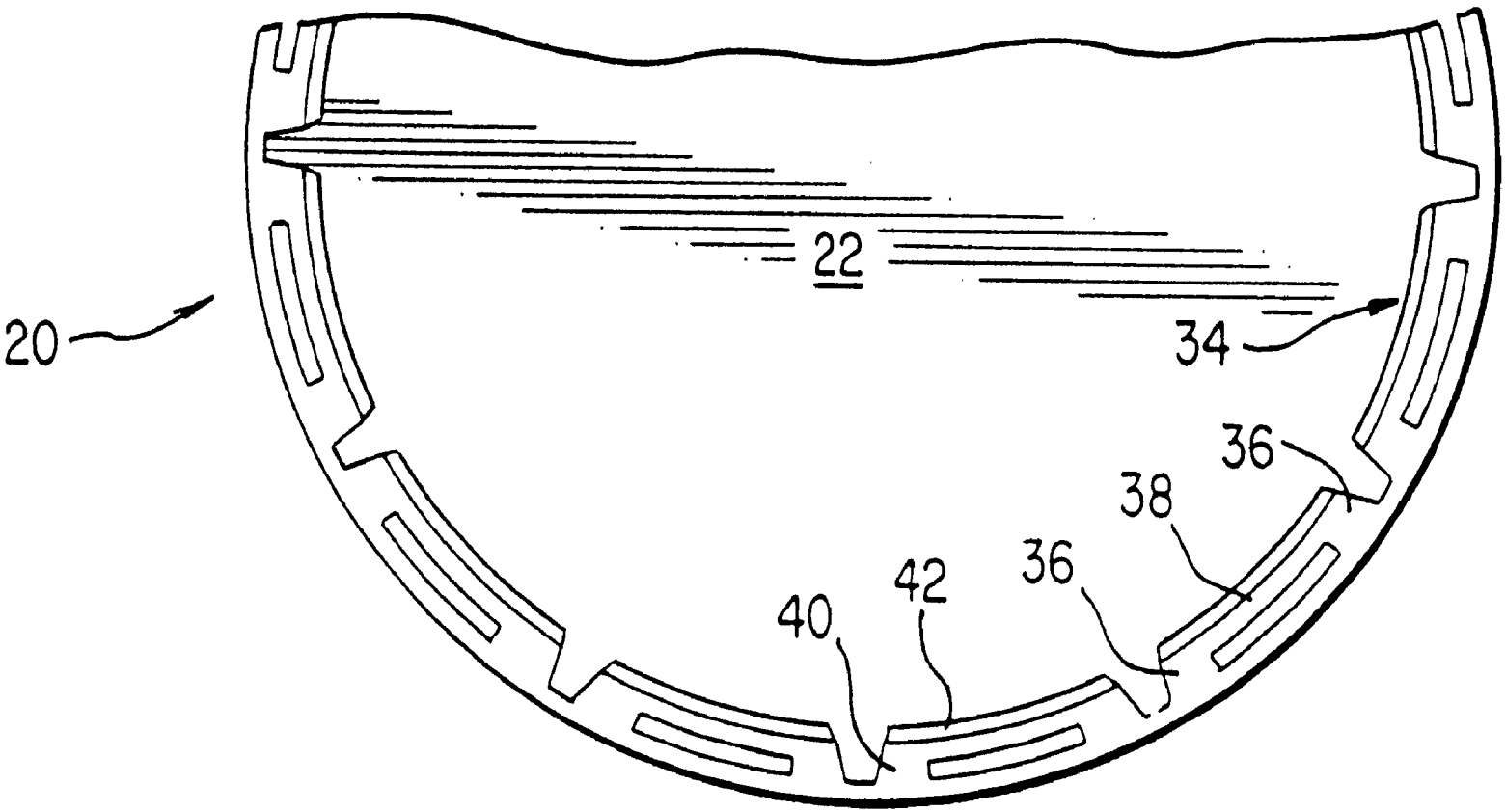
FIG. 2 is a bottom view of the closure of FIG. 1.

The geometric shape of tab 34 creates a bi-stable configuration that has equilibrium positions in both a downward orientation and an upward orientation. In particular, tamper indicating band 30 may be molded with tabs 34 in the downward and inward orientation, for example at approximately 60° from the horizontal. This configuration is illustrated in FIGS. 1, 2 and 5. As noted above, molding tabs 34 in the downward orientation provides manufacturing advantages compared to molding tabs 34 in an upward orientation.

Figure 3:
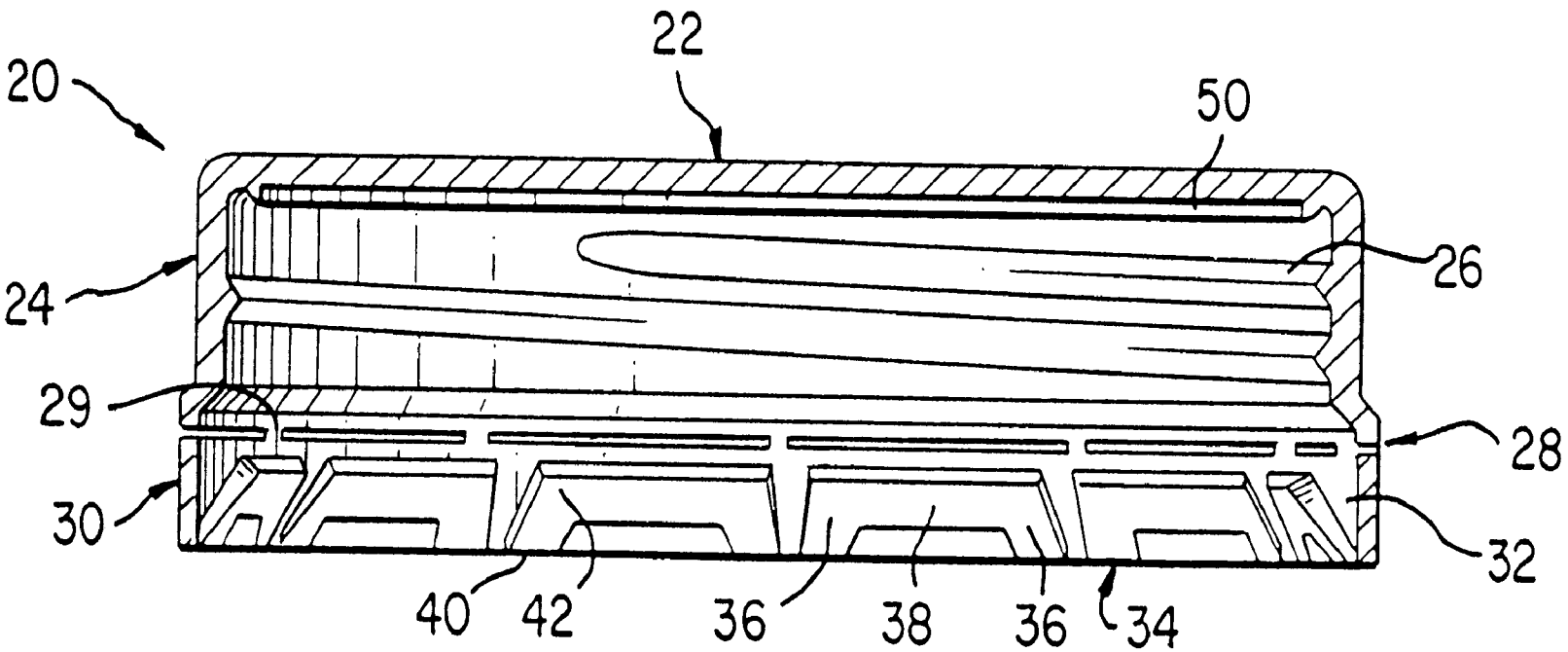
FIG. 3 is a side cross-sectional view of an exemplary closure according to the present invention having tabs in an upward orientation.
Figure 4:
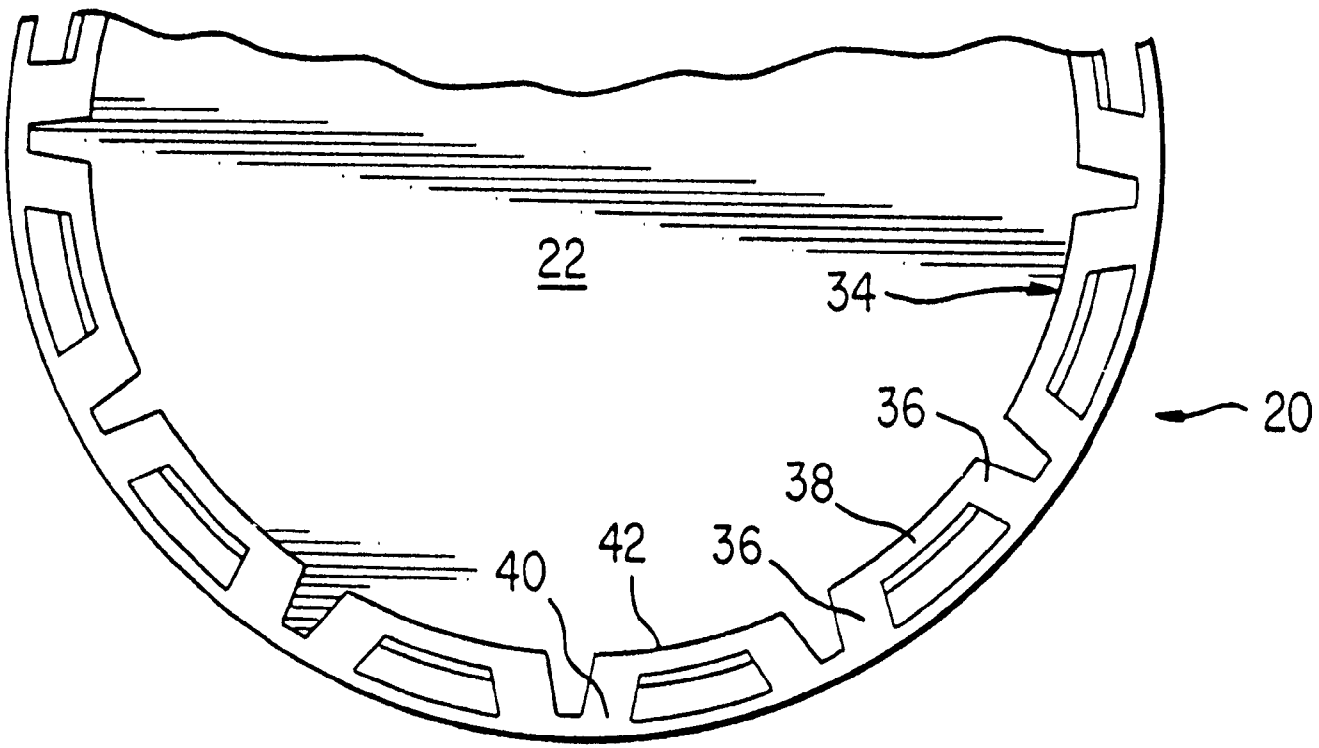
FIG. 4 is a bottom view of the closure of FIG. 3.

After molding, tabs 34 may be folded to an upward orientation. Because transverse member 38 is relatively thick compared to the base of each extending member 36, it does not tend to compress or flex significantly during folding. Rather, the folding action biases extending members 36 outwardly away from one another as tab 34 approaches the horizontal. At a point near the horizontal, extending members 36 are at a maximum outward angle. Once past the horizontal, continued upward motion tends to return extending members 36 to their original, inwardly-directed angle. Accordingly, as tab 34 is first moved upward, the tendency of extending members 36 to return to their original angle biases tab 34 toward the downward orientation. If tab 34 were released prior to reaching the horizontal, it would return to the downward orientation. However, once tab 34 passes a point approximately at the horizontal, then it will become biased toward the upward orientation. When tab 34 is released after passing this point, it will move toward the stable upward orientation, for example approximately 60° above the horizontal. This position is illustrated in FIGS. 3, 4 and 6.

With tabs 34 in the upward orientation, closure 20 can be applied to container 10, and tabs 34 may be biased further upward to pass over shoulder 16 of the container. Once past shoulder 16, tabs 34 may return to the normal upward orientation and lock under shoulder 16. In this position, tabs 34 may contact neck 12, shoulder 16, or both. Alternatively, tabs 34 may rest just under shoulder 16 without contacting shoulder 16 or neck 12. When closure 20 is removed, tabs 34 will contact shoulder 16 to prevent tamper indicating band 30 from removal from container 10 with the remainder of closure 20. Tamper indicating band 30 will therefore separate from skirt 24 along frangible line 28, providing tamper indication.

Closure 20 and container 10 may be formed from any suitable materials and may be constructed using any suitable processes. Preferably closure 20 is a unitary member (including tamper indicating band 30) and is made of plastic. Preferred plastics include polypropylene and polyethylene. Closure 20 is preferably formed by compression or injection molding. Container 10 is also preferably a unitary member formed of either glass or plastic, preferred plastics including polyethylene terephthalate ("PET"), polypropylene, and polyethylene. Container 10 is preferably formed using a blow molding process, and in particular if PET is employed then container 10 is preferably stretch blow molded. Tabs 34 may be folded using any suitable process. Preferably, however, tabs 34 are folded by punch pressing tabs 34 upwardly.

The device according to the present invention has been described with respect to several exemplary embodiments. It can be understood, however, that there are many other variations of the above-described embodiments which will be apparent to those skilled in the art, even where elements have not explicitly been designated as exemplary. For example, closure 20 may include an annular sealing ring 50 to help seal the contents of the container 10 from contamination or spoiling. Similarly, closure 20 may include a plurality of ridges on the outer surface of skirt 24 to provide a frictional gripping surface for the consumer. It is understood that these and other modifications are within the teaching of the present invention, which is to be limited only by the claims appended hereto.

What is claimed is:

1. A method of producing a tamper indicating closure, the method comprising:

(a) molding a closure including a top wall, a skirt, and a tamper indicating band, the tamper indicating band including a ring and a plurality of trapezoidal tabs each connected to the ring at a base, each tab having a transverse member and extending members, a maximum thickness of the transverse member being substantially equal to a maximum thickness of a tip of each extending member when said thickness are measured in the same direction, and each of the tabs having a trapezoidal hole therethrough, each of the plurality of tabs being molded in a downward orientation; and (b) folding the tabs to a stable inward and upward orientation.

2. The method according to claim 1, wherein the step of molding includes one of injection and compression molding.

3. The method according to claim 2, wherein the step of folding includes punch pressing the tabs to the stable inward and upward orientation.

* * * * *